US007916036B1

(12) United States Patent
Pope et al.

(10) Patent No.: US 7,916,036 B1
(45) Date of Patent: Mar. 29, 2011

(54) PATIENT POSITION MONITOR WITH TIMER

(75) Inventors: Philip Kevin Pope, Lincoln, NE (US); Joel R. Hoerth, Lincoln, NE (US); Harold Todd Tyler, Lincoln, NE (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 366 days.

(21) Appl. No.: 11/958,136

(22) Filed: Dec. 17, 2007

Related U.S. Application Data

(60) Provisional application No. 60/875,288, filed on Dec. 15, 2006, provisional application No. 60/875,289, filed on Dec. 15, 2006.

(51) Int. Cl.
*G08B 23/00* (2006.01)
*G08B 1/00* (2006.01)
*G04B 47/00* (2006.01)

(52) U.S. Cl. ..... 340/573.4; 340/573.1; 340/575; 340/667; 340/309.16; 200/85 A; 368/1; 368/10

(58) Field of Classification Search ..... 340/573.4
See application file for complete search history.

(56) References Cited

U.S. PATENT DOCUMENTS 4,228,426 A 10/1980 Roberts
4,242,672 A 12/1980 Gault
4,633,237 A 12/1986 Tucknotte et al.
4,638,307 A 1/1987 Swartout
6,116,639 A 9/2000 Breed et al.
6,160,478 A 12/2000 Jacobsen et al.
6,166,644 A 12/2000 Stroda
6,201,476 B1 3/2001 Depeursinge et al.
6,208,251 B1 3/2001 Cadet et al.
6,307,476 B1 10/2001 Smith et al.
6,570,503 B1 5/2003 Ulert et al.
6,611,783 B2 8/2003 Kelly, Jr. et al.
6,646,556 B1 11/2003 Smith et al.
6,784,797 B2 8/2004 Smith et al.
6,791,460 B2 9/2004 Dixon et al.
6,847,301 B1 1/2005 Olson
6,914,536 B2 7/2005 Gratkowski
6,917,293 B2 7/2005 Beggs
6,985,408 B2 * 1/2006 Quine ..... 368/10
6,998,986 B2 2/2006 Smith
7,017,195 B2 3/2006 Buckman et al.
7,557,719 B1 * 7/2009 Long ..... 340/573.4
2002/0067273 A1 6/2002 Jaques et al.
2002/0101349 A1 8/2002 Rojas, Jr.
2002/0196148 A1 12/2002 Nunome
2005/0067816 A1 3/2005 Buckman
2006/0056655 A1 3/2006 Wen et al.

* cited by examiner

*Primary Examiner* — Donnie L Crosland
(74) *Attorney, Agent, or Firm* — Baker & Daniels LLP

(57) ABSTRACT

A patient position pad is provided that includes a timer. The patient position pad is configured to detect the position of a patient. The timer is configured to track the useful life of the patient position pad.

22 Claims, 4 Drawing Sheets

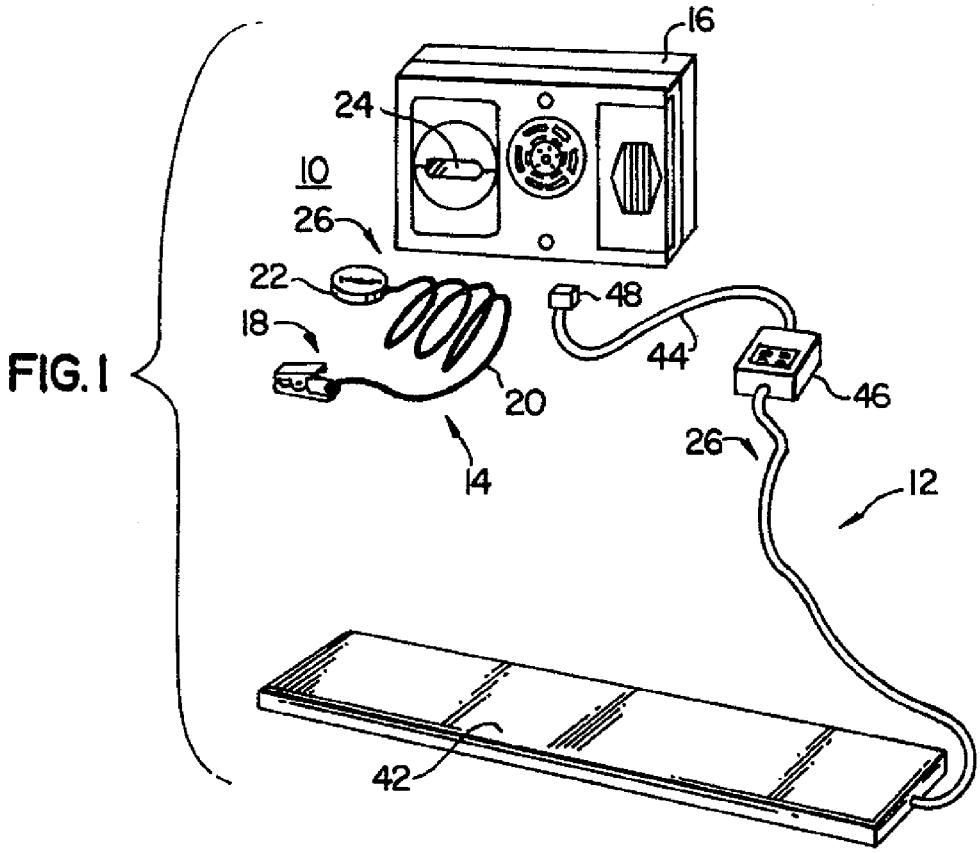
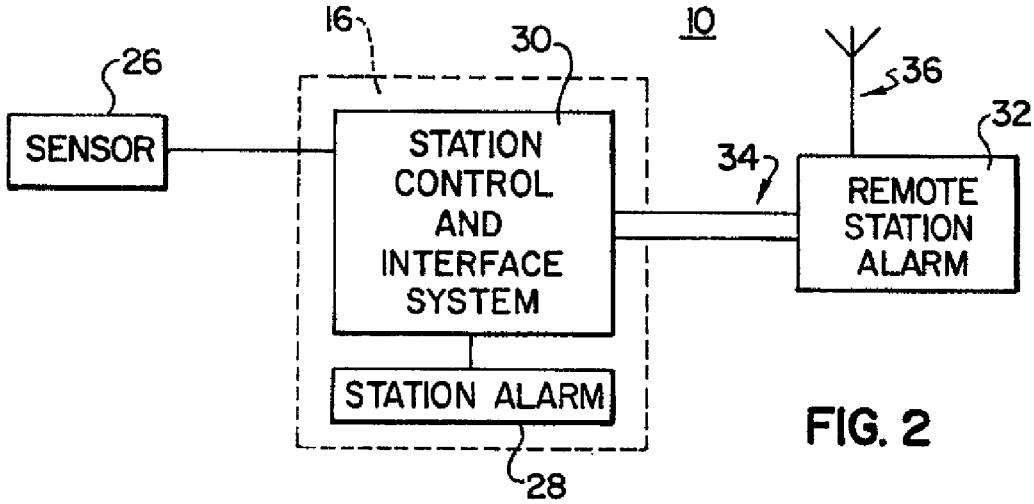
FIG. 2

PATIENT POSITION MONITOR WITH TIMER

RELATED APPLICATIONS

The present application claims priority to U.S. Provisional Patent Application Ser. No. 60/875,289, titled "Patient Monitoring System with Timer" to Pope et al., filed Dec. 15, 2006, and U.S. Provisional Patent Application Ser. No. 60/875,288, titled "Patient Monitoring System" to Murray et al., filed Dec. 15, 2006, the disclosures of which are expressly incorporated by reference herein.

BACKGROUND AND SUMMARY OF THE INVENTION

The present invention relates generally to patient monitoring systems.

BRIEF DESCRIPTION OF THE DRAWINGS

The detailed description of the drawing particularly refers to the accompanying figures in which:

FIG. 1 is a perspective view of a patient monitoring system;

FIG. 2 is a block diagram of a patient monitoring system;

DETAILED DESCRIPTION OF THE ILLUSTRATED EMBODIMENTS

Figure 3:
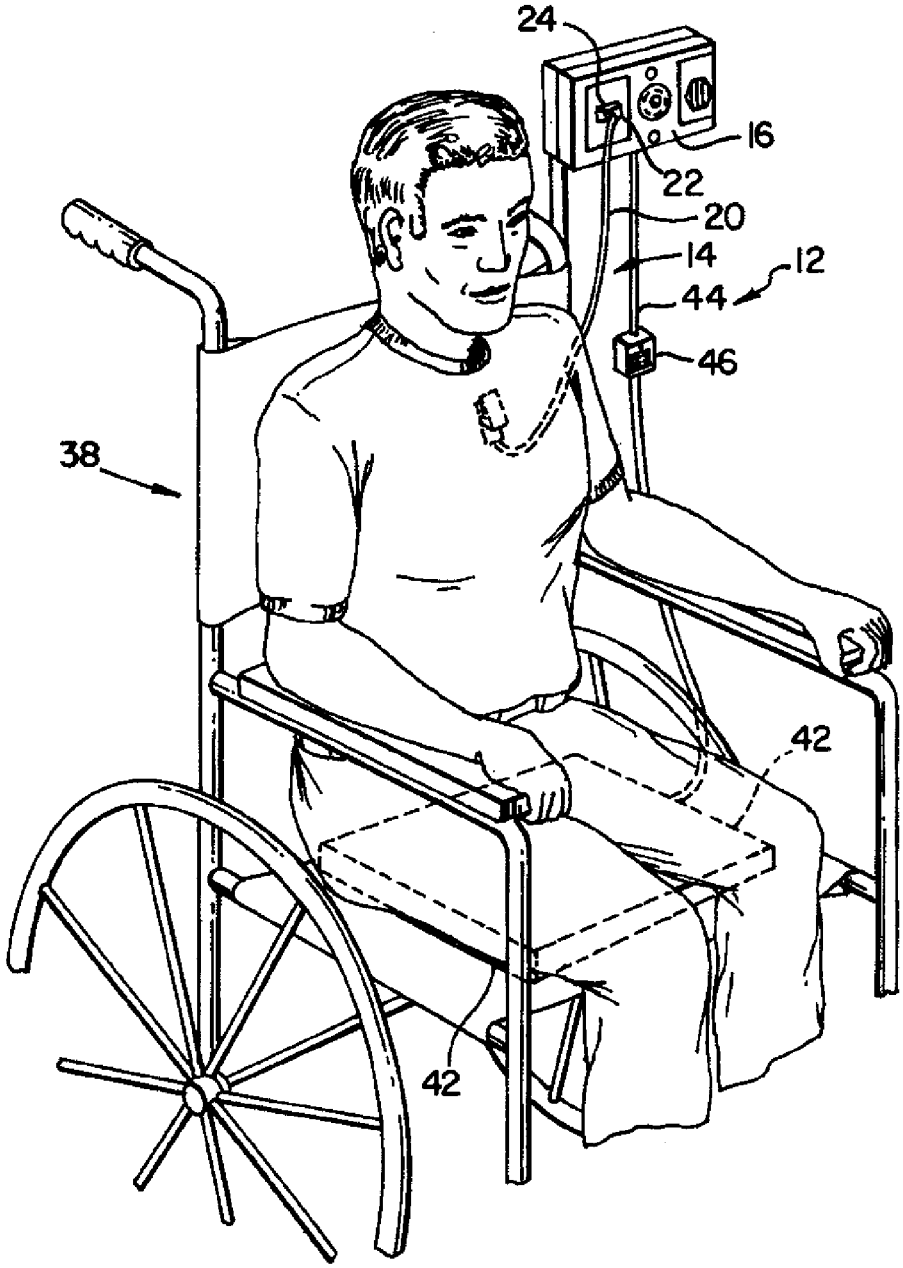
FIG. 3 is a perspective view illustrating the use of the patient monitoring system in connection with a wheelchair.

The embodiments disclosed below are not intended to be exhaustive or to limit the claimed invention to the precise forms disclosed in the following detailed description. Rather, the embodiments are chosen and described so that others skilled in the art may utilize their teachings.

In FIG. 1, there is shown a perspective view of a patient monitoring system 10 having a pressure pad 12, a cord switch 14, and a monitor 16. A microprocessor (not show) within monitor 16 is electrically connected to pressure pad 12 (a first sensor) to cooperate with it and receive a signal when pressure is applied to pad 12 or released from pad 12. Cord switch 14 (a second sensor) includes an alligator clip 18, a cord 20 and a magnetic shunt 22 adapted to fit into a slot 24 in monitor 16. Alligator clip 18 is on one end of cord 20 and shunt 22 on the other.

According to the exemplary embodiment of the present disclosure, pad 12 is configured to provide a notification to a care provider or other personnel when pad 12 is approaching or has reached its predetermined end of useful life. When a care giver notices pad 12 is approaching or has reached its predetermined end of life, it is replaced with a new pad 12.

Alligator clip or other connector 18 is fastened to the clothing of the patient and disk 22 put into slot 24. When it is removed such as by the person moving a distance greater than that of cord 20, an alarm and/or voice is sounded. Similarly, when pressure is placed on either pad 12 in a wheelchair embodiment or in a bed near the shoulders or buttocks of a patient, a flag on the microprocessor is set so that when the patient releases the pressure such as by getting up from the seat of the wheelchair or sitting up if on a bed, the microprocessor receives a signal resulting in an alarm or voice message and alarm.

The input circuits for the microprocessor may be incorporated within monitor 16 and its role is to develop a signal for the microprocessor when pressure is applied on pressure pad 12, which in the exemplary embodiment is a pad that reduces resistance when pressure is placed upon it. Other types of pressure pads and other components of patient monitoring systems are known in the art and any of them may be used, such as those described in U.S. Pat. Nos. 6,166,644; 5,796,059; 4,263,586; and 4,020,482, the disclosure of which are expressly incorporated by reference herein. These sensor may be configured to detect changes in fluid or air pressures, capacitance, inductance, electrical resistance, optical properties, or any other detectable changes in condition.

The pressure pad described in the aforementioned U.S. Pat. No. 5,796,059 is able to provide signals indicating the location on the pad of pressure and thus, with the aid of the microprocessor detect and indicate shifts in position of the patient such as tilting in a wheelchair or moving to the edge of a bed. While in the preferred embodiment the pressure pad is placed under the bedding it can be placed at other locations such as under the mattress. Moreover, it may be used with an analyzer such as the microprocessor to detect direction of movement such as whether a patient is moving toward a door or away from a door by detecting directional changes in pressure.

In FIG. 2, there is shown a block diagram of patient monitoring system 10 having a sensor 26 (such as pad 12 or cord switch 14), monitor 16, a station alarm system 28, a station control and interface system 30, and a remote station alarm 32. Patient-station monitoring monitor 16 may include a voice record system in the manner disclosed in U.S. Pat. No. 5,494,046 for providing verbal instructions to a patient under certain sensed conditions. As in the case of the system described in U.S. Pat. No. 5,494,046, the disclosure of which is incorporated herein for reference, an alarm is given at the station with the patient and/or a nurses station before a voice carries a message to the patient so that immediately upon the sensing of an alarm condition, the attendants receive notification and can proceed to the aid of the patient.

Station alarm 28 may include a lamp or a buzzer or the like and remote station alarm 32 may be connected with or without wires 34 to receive an alarm such as at a remote location such as a nursing station or may have an antenna 36 which receives a signal from the station alarm or transmits a signal to other stations so as to provide an alarm at those stations. The alarms at the remote stations may also be any type of indicator such as a lamp, a buzzing sound, a ringing sound, a horn-like sound, or a voice.

While in the embodiment of FIG. 2, alarms are provided before the message is played both near the patient and at a remote location, the alarm nearby from the station alarm may be omitted and the signal transmitted directly to the remote station or alarm 32 or the message may be played simultaneously with either or both the station alarm 28 and remote alarm 32 or before either or both alarms. The voice system may be any standard commercial arrangement such as are now commonly used to play a fixed or variable message.

In FIG. 3, there is shown a pressure pad 12 positioned under a patient on a wheelchair 38. Pressure pad 12 is intended to be on the seat of wheelchair 38 to provide a signal if the patient leaves wheelchair 38. With this arrangement, if the patient were to move further away from pressure pad 12, such as leaving wheelchair 38, pressure is released on pad 12 and a signal would be given to provide an alarm. If the patient slumps forward, pressure is released on pressure pad 12, monitor 16 provides an alarm signal to a caretaker, preferably at a remote location. The recorded message in an embodiment of this type may request the patient to remain stationary until aid arrives.

Figure 4:
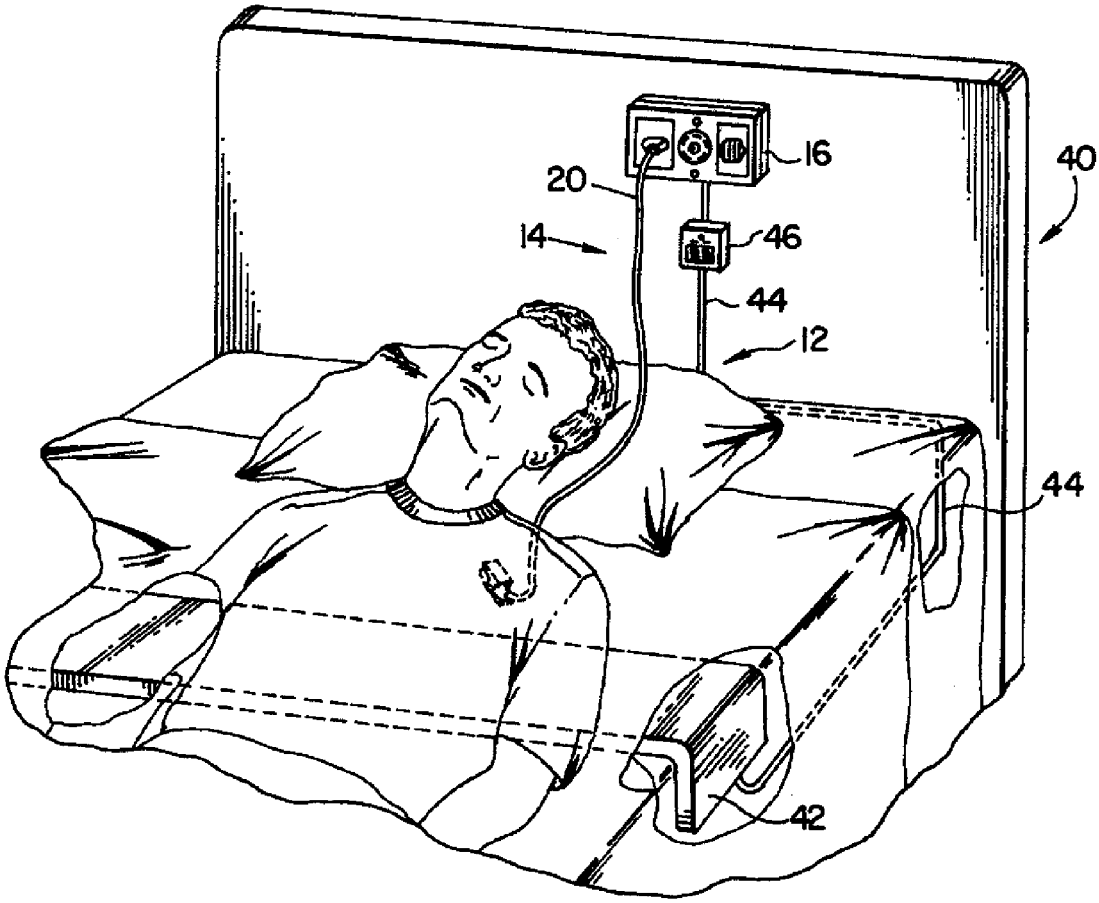
FIG. 4 is a perspective view illustrating the use of the patient monitoring system in connection with a bed.

In FIG. 4, there is shown a perspective view of a bed 40 equipped with a patient monitor 16. If the patient moves away from bed 40 or attempts to leave, pressure pad 12 receives less weight and generates a signal. Pressure pad 12 is preferably placed under the shoulders of the patient, but may be placed in other locations. A message may be played requesting the patient to remain in bed 40 and/or an alarm may be transmitted to a caretaker who can attend to the matter.

Figure 5:
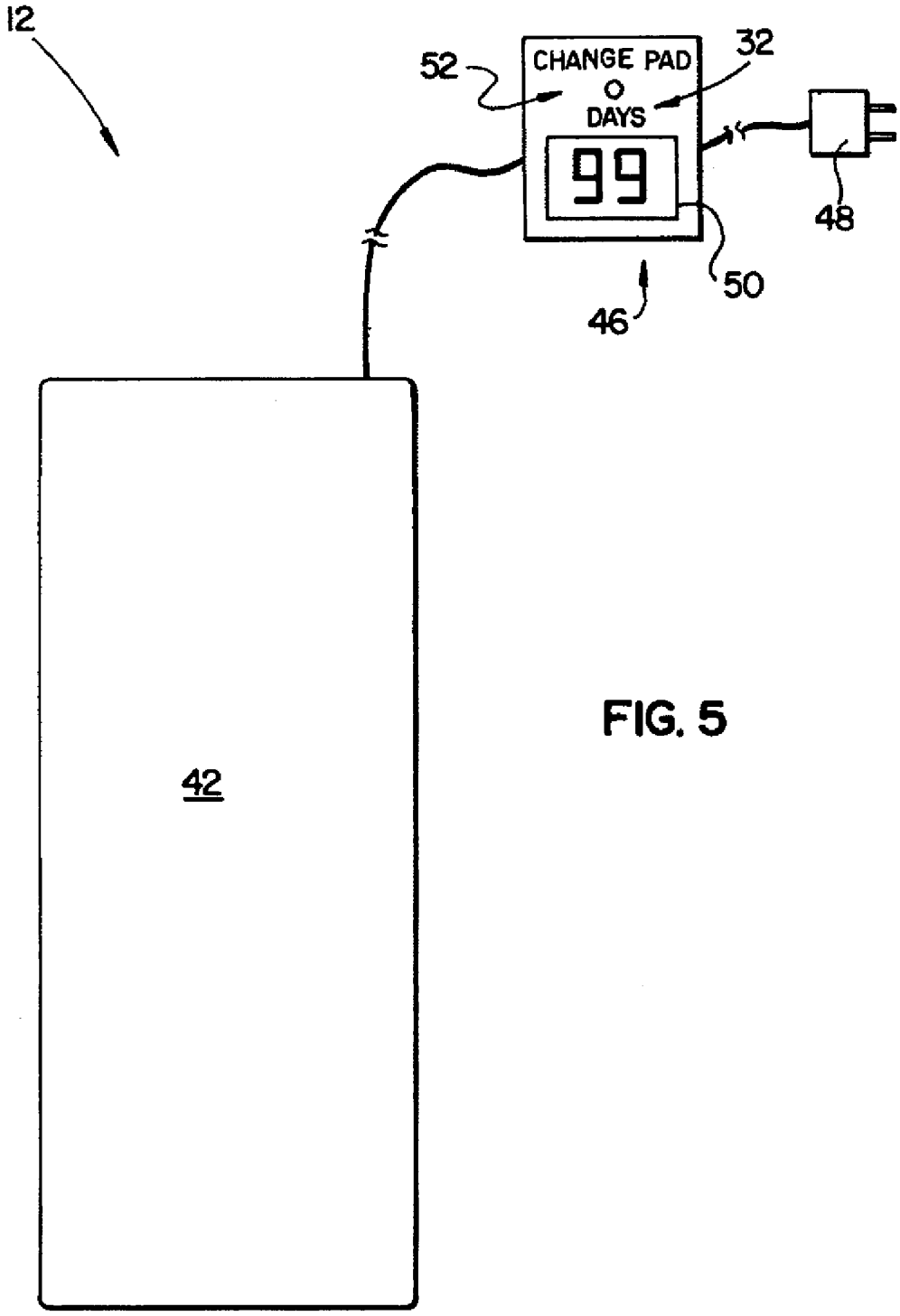
FIG. 5 is an enlarged view of a timer provided with the patient monitoring system.

Pressure pad 12 includes a switch or sensor portion 42, cord 44, timer 46, and plug 48. Timer 46 provides an indication of how long pad 12 has been in service and/or how much predetermined useful life pad 12 has left. As shown in FIG. 5, timer 46 includes an character indicator, such as exemplary LCD display 50, and an binary indicator, such as exemplary LED 52. LCD display 50 and LED 52 may be provided together or separately on timer 46.

Timer 46 also includes an internal timer (not shown) that determines the amount of remaining useful life of the particular pad 12. The internal timer may include a logic device, such as a microprocessor or other logic device with its own clock or a separate clock circuit. Each pad 12 includes a designed period of useful life, such as 45 days, 90 days, 180 days, or 365 days that is programmed into the microprocessor or other logic device. The useful life is preferably programmed into the logic device at the site of manufacture of timer 46 before shipment to the care provider, but may be programmed at any other time.

Once pad 12 is plugged into monitor 16 with plug 48, timer 46 is automatically triggered to begin counting down the number of useful days left for pad 12. Similarly, timer 46 may also count the number of days that pad 12 has been in use. When plugged in, the microprocessor of timer 46 detects that pad 12 has been plugged in and begins to count down the remaining useful life of pad 12. Other triggering devices, such as mechanical, electrical, or other switches and other trigger devices, may also be provided to start the countdown of the internal timer. Before being activated, LCD display 50 is blank and LED 52 remains off to conserve energy.

After timer 46 is plugged into monitor 16 (or otherwise triggered), LCD display 50 indicates the remaining useful life of pad 12. For example, as shown in FIG. 5, LCD display 50 of pad 12 is indicating that pad 12 has 99 days of useful life remaining. Timer 46 also includes a battery (not shown) so that if pad 12 is unplugged from monitor 16, it will continue to countdown and display the number of days remaining. If pad 12 is plugged into the same monitor 16 or another monitor 16, the exemplary timer 46 will not reset, but continue to countdown the remaining useful life based on the original trigger event.

When 3 days of useful life are left on the exemplary pad 12, LED 52 will begin to flash on and off indicating that it is near time to change pad 12 with a new pad 12. LCD display 50 will continue to count down the days until it reaches zero days. When there are zero days remaining, LED 52 will continue to flash and LCD display 50 will display 00 days. Time periods other than 3 days may also be used to activate LED 52 or any other indicator.

In addition to LED 52 flashing and display 18 indicating 00 days, timer 46 may also generate an audible alarm through use of a speaker, buzzer, or other audio device indicating that the end of the useful life is approaching and/or has been reached. Alternatively, timer 46 may also send a signal or other indication to monitor 16 that the end of life is approaching or has been reached. This causes monitor 16 to also provide an audible alarm. The audible alarm of timer 46 and/or monitor 16 may be a "beep" that occurs at regular intervals, such as every minute. The audible alarm may be provided with or without the visual indicators. Further, timer 46 and/or monitor 16 may send a wired or wireless signal to a remote location, such as a nurse call station, indicating that pad 12 is approaching and/or has reached the end of its useful life. The communication may include the ID of pad 12, location of pad 12, patient information, remaining useful life of pad 12, if any, or any other information useful in identifying the respective pad 12.

When the care provider notices it is time to replace pad 12, the care provider removes the old pad 12 and replaces it with a new pad 12. Once new pad 12 is plugged into monitor 16 or otherwise activated, its timer 46 begins to countdown the remaining days of its useful life.

As shown in FIG. 5, timer 46 is located relatively close to plug 48 to provide a convenient location for viewing by a care provider. However, timer 46 may be positioned anywhere on pad 12 or monitor 16. Similarly, the various components and features may be provided at different locations on pad 12, monitor 16, or elsewhere rather than concentrated in the single housing of timer 46. According to the exemplary embodiment, timer 46 is positioned about seven inches from plug 48. As shown in FIG. 3, timer 46 will hang below monitor 16, making it relatively easy for a care provider to view.

To keep display 50 facing outward toward a care provider, cord 44 (or any other portion of pad 12) is optionally coupled to the head board of bed 40 or to any other suitable portion of bed 40, such as the bed frame. Cable ties, hook-and-loop type fasteners, or other suitable fasteners may be used to couple cord 44 to bed 40. Similarly, cord 44 (or any other portion of pad 12) may be coupled to wheelchair 38 or any other structure, such as a support for monitor 16, an IV-pole, or any other structure, to keep display 50 facing outward toward the care provider.

To further enhance the ability to see the information provided by timer 46, multiple displays 50 and LED's 52 may be provided on timer 46 on different sides of timer 46. By providing multiple displays 50 and LED's 52, the likelihood of one of sets of displays 50 and LED's 52 is facing out toward the care provider is increased. Preferably, when only two sets of displays 50 and LED's 52 are provided, they are positioned on opposite sides of timer 46.

Timer 46 may also include additional or alternative visual devices (such as incandescent lights, OLED's, and other known visual devices) that provide the same or different information that is provided by display 50 and LED 52. For example, a series or line of LED's may be provided for indicating how many days are left in the useful life of timer 46. After a day (or other time period) passes, one of the series of LED's no longer lights up to indicate that less time is left in the useful life. Other visual, audio, or other sensory means of indicating how much useful life is left (or spent) for pad 12 may also be provided. Similarly, scrolling text may be provided on display 50 to provide additional information and instructions to the care providers or others. LED's positioned adjacent to preprinted condition text may be provided to indicate that the printed condition exists when the LED is on. For example, as shown in FIG. 5, "Change Pad" is positioned adjacent to LED 52 to indicate that it is time (or about time) to change pad 12. Different color LED's could also be provided to indicate the status of pad 12. For example, a green LED could indicate that pad 12 is several days from the end of its useful life, a yellow LED could indicate that pad 12 is approaching the ends of its useful life, and a red LED could indicate that pad 12 has reached the end of its useful life. Many other devices or methods of communicating the above described information may also be used.

In addition to the features described herein, pad 12 and/or monitor 16 may include other features, such as dual reset buttons; remote reset and other features described in U.S. Patent Application Ser. No. 60/875,288, filed on Dec. 15, 2006, entitled "Patient Monitoring System" to Murray et al., the disclosure of which is expressly incorporated by reference herein; selectable alarm tones and volumes; or any other features suitable for a patient position pad and/or monitor.

The invention claimed is:

1. A patient position pad including a sensor portion configured to detect the position of a patient and a timer permanently coupled to the sensor portion and configured to track the useful life of the patient position pad, and a cord having a first end coupled to the sensor portion and a second end configured to couple to a patient position monitor, wherein the timer is positioned between the second end and the sensor portion.

2. The patient position pad of claim 1, wherein the timer includes a sensor that detects when the second end is coupled to the patient position monitor to begin tracking the useful life of the patent position pad.

3. The patient position pad of claim 2, wherein the timer continues to track the useful life of the patient position pad after the second end is uncoupled from the patient position monitor.

4. The patient position pad of claim 1, wherein the timer includes a display indicating the remaining useful life of the patient position pad.

5. The patient position pad of claim 1, wherein the timer includes an indicator that indicates the end of the useful life of the patient position pad is approaching.

6. A patient monitoring system including a patient position monitor including a housing and an alarm, and a patient position sensor configured to detect the position of a patient, the patient position monitor being configured to communication with the patient position monitor to activate the alarm when the patient moves from a desired position, the patient position sensor including a timer that monitors the useful life of the patient position sensor, wherein the patient position sensor further includes a sensor portion configured to detect the position of the patient and a cord having a first end configured to couple to the patient position monitor and a second end coupled to the sensor portion, the first end of the cord is positioned between the timer and the patient position monitor.

7. The patent monitoring system of claim 6, wherein the timer begins monitoring the useful life of the patient position sensor when the patient position sensor is coupled to the patient position monitor.

8. The patient monitoring system of claim 6, wherein the timer is positioned between the first and second ends of the cord.

9. The patient monitoring system of claim 6, wherein the timer includes a display indicating the remaining useful life of the patient position sensor.

10. The patient monitoring system of claim 6, wherein the timer includes an indicator indicating that the patient position sensor is within a predetermined amount of time until the end of the useful life of the patient position sensor.

11. A patient monitoring system including a patient position monitor including a housing and an alarm, a sensor portion configured to detect the position of a patient, the sensor portion being configured to communication with the patient position monitor to activate the alarm when the patient moves from a desired position, and a timer that monitors the useful life of the sensor portion while the sensor portion is in communication with the patient position monitor and after communication with the patient position monitor ends, wherein the timer begins monitoring the useful life of the sensor portion when the sensor portion is coupled to the patient position monitor.

12. The patient monitoring system of claim 11, further comprising a cord having a first end configured to couple to the patient position monitor and a second end coupled to the sensor portion, the first end of the cord is positioned between the timer and the patient position monitor.

13. The patient monitoring system of claim 12, wherein the sensor portion, the timer, and the cord cooperate to comprise a disposable patient position pad.

14. The patient monitoring system of claim 12, wherein the timer is positioned between the first and second ends of the cord.

15. The patient monitoring system of claim 11, wherein the timer includes a display indicating the remaining useful life of the sensor portion.

16. The patient monitoring system of claim 11, wherein the timer includes an indicator indicating that the sensor portion is within a predetermined amount of time until the end of the useful life of the sensor portion.

17. A patient monitoring system including a patient position monitor including a housing and an alarm, a sensor portion configured to detect the position of a patient, the sensor portion being configured to communication with the patient position monitor to activate the alarm when the patient moves from a desired position, and a timer that monitors the useful life of the sensor portion, the timer including a display indicating a remaining useful life of the sensor portion.

18. The patient monitoring system of claim 17, wherein the timer begins monitoring the useful life of the sensor portion when the sensor portion is coupled to the patient position monitor.

19. The patient monitoring system of claim 17, further comprising a cord having a first end configured to couple to the patient position monitor and a second end coupled to the sensor portion, the first end of the cord is positioned between the timer and the patient position monitor.

20. The patient monitoring system of claim 19, wherein the sensor portion, the timer, and the cord cooperate to comprise a disposable patient position pad.

21. The patient monitoring system of claim 19, wherein the timer is positioned between the first and second ends of the cord.

22. The patient monitoring system of claim 17, where the timer further includes an indicator indicating that the sensor portion is within the predetermined amount of time until the end of the useful life of the sensor portion.

* * * * *